United States Patent [19]

Kobrehel

[11] Patent Number: 4,706,412

[45] Date of Patent: Nov. 17, 1987

[54] VEHICLE CABLE WINDOW REGULATOR AND SLIDER GUIDE ASSEMBLY

[75] Inventor: Michael D. Kobrehel, Southgate, Mich.

[73] Assignee: General Motors Corporation, Detroit, Mich.

[21] Appl. No.: 885,285

[22] Filed: Jul. 14, 1986

[51] Int. Cl.[4] ..... E05F 11/48

[52] U.S. Cl. ..... 49/352

[58] Field of Search ..... 49/352, 502, 374, 375

[56] References Cited

U.S. PATENT DOCUMENTS 4,589,227 5/1986 Bickerstaff ..... 49/352 X

FOREIGN PATENT DOCUMENTS 7911713 7/1979 France ..... 49/352

*Primary Examiner*—Kenneth Downey

*Attorney, Agent, or Firm*—Ernest E. Helms

[57] ABSTRACT

The present invention provides an improved vehicle cable window regulator with an improved and simplified slider guide assembly. The slider guide assembly of the present invention utilizes a single length of cable which is nondeformably held in a curvilinear groove of the guide.

5 Claims, 5 Drawing Figures

VEHICLE CABLE WINDOW REGULATOR AND SLIDER GUIDE ASSEMBLY

FIELD OF THE PRESENT INVENTION

The field of the present invention is that of vehicle window cable regulators. More particularly, the present invention relates to vehicle cable window regulators and their slider guide assemblies.

DISCLOSURE STATEMENT

Vehicle cable window regulators are well known in the art. Typically, there is provided a reversible rotatable drum which is manually or electrically operated to translate a wire cable which is, in turn, attached with the window. To provide a fixed path, the cable is directed into a vertical or inclined channel. The channel has two rollers rotatively mounted at its opposite ends.

Slidably mounted in the channel is a guide. The guide is fixably connected to the cable. Attached with the guide is the slider. The slider is slidably mounted in a horizontally open horizontal groove of a sash which, in turn, is fixably connected with the windowpane. The sash has a vertically open horizontal groove within which the lower edge of the windowpane is nested.

Almost all cable window regulator systems require some type of mechanism to take out slack in the cable. Therefore, most cable window regulators attach the ends of the cable to the drum so that any spring loaded mechanism required to take out the slack in the cable can be attached to the drum housing.

The prior art window regulator required one piece of cable from the drum over the channel's top roller to the guide to provide the upward pulling force when raising the window. Likewise, a second cable connected to the guide extending around the bottom roller to the drum was required for lowering the window. A disadvantage of the above described cable regulator is that it requires two separate cable members.

A leading cause of failure in cable window regulators is failure of the cable. Therefore, cuts or deformations of the cable should be minimized as much as possible. Prior to the present invention, one of the more popular techniques for securing the cable to the guide was to thread the cable through a short tubular passage of the guide and then stake a bushing on the end of the cable. The staked bushing prevented the cable from being pulled away from the guide and also prevented the unraveling of the cable.

At the connection of the cable with the guide the tension forces, which are experienced in the cable, are coaxial with the axis of the bushing on the cable. Therefore, the cable has a tendency to be pulled out of its bushing.

A second technique of attaching the cable to the guide is to deform a portion to the guide to crimp the cable. The above technique deletes the requirement of two separate cables. Deformably crimping the cable by the guide is disadvantageous in that it does not allow the guide to be manufactured from a non-metallic substance such as plastic. Secondly, and more importantly, the crimping of the cable by the guide deforms the cable and causes damage to the cable thereby rendering the cable more susceptible to failure.

Another disadvantage of prior guide slider assemblies is that a first pin is connected with the guide to transmit structural force from the cable to the guide. A second separate pin riveting member is provided to transmit the structural forces from the window via the slider to the guide. The above configuration required at least two separate metallic load bearing parts.

SUMMARY OF THE INVENTION

To overcome the above noted and other problems the present invention is brought forth. The present invention provides a vehicle cable window regulator with a single cable member held to the guide nondeformably within a curvilinear groove of the guide.

The present invention is advantageous in that the cable's only staked bushing ends are at the cable's attachment to the drum. At the drum, the cable is wrapped at least 180 degrees before the cable is connected to the drum. Therefore, the tension forces experienced by the cable at its staked end are diminished by the frictional engagement of the cable with the drum. Therefore, the cable has less of a tendency of being pulled out from the staked bushing.

The present invention is also advantageous in that it provides a single pin or rivet which commonly transmits the loads from the cable to the glass via the guide and slider assemblies.

It is the object of the present invention to provide a cable vehicle window regulator which utilizes a single length of cable. It is another object of the present invention to provide a vehicle cable window regulator with a single length of cable wherein the cable is attached in a nondeformable manner with the guide. It is still another object of the present invention to provide a vehicle cable window regulator slider guide assembly using a common load bearing pin.

It is a further object of the present invention to provide an improved vehicle cable window regulator having a reduced number of parts, the regulator comprising in combination, a reversible, rotatable drum, a single cable having both ends affixed with the drum, a channel providing a fixed path, a plastic guide slidably mounted on the channel, the guide providing a curvilinear groove having a constant radius for arc of between 180 and 150 degrees for the cable, a pin transversely projecting through the guide deformed at one end; a slider mounted to the pin opposite the guide, a sash having a first horizontal groove for insertion of the slider, and the sash having a second groove wherein the bottom edge of the window may be nested therein, and a bowl-shaped washer surrounding the pin and mated with the guide opposite the slider by the pin, the washer trapping the cable on the outer curvature of the washer whereby the cable is nondeformably secured to the guide.

Other objects, desires and advantages of the present invention will become more apparent to those skilled in the art as the nature of the invention is better understood from the accompanying drawings and a detailed description.

DETAILED DESCRIPTION OF THE DRAWINGS

Figure 1:
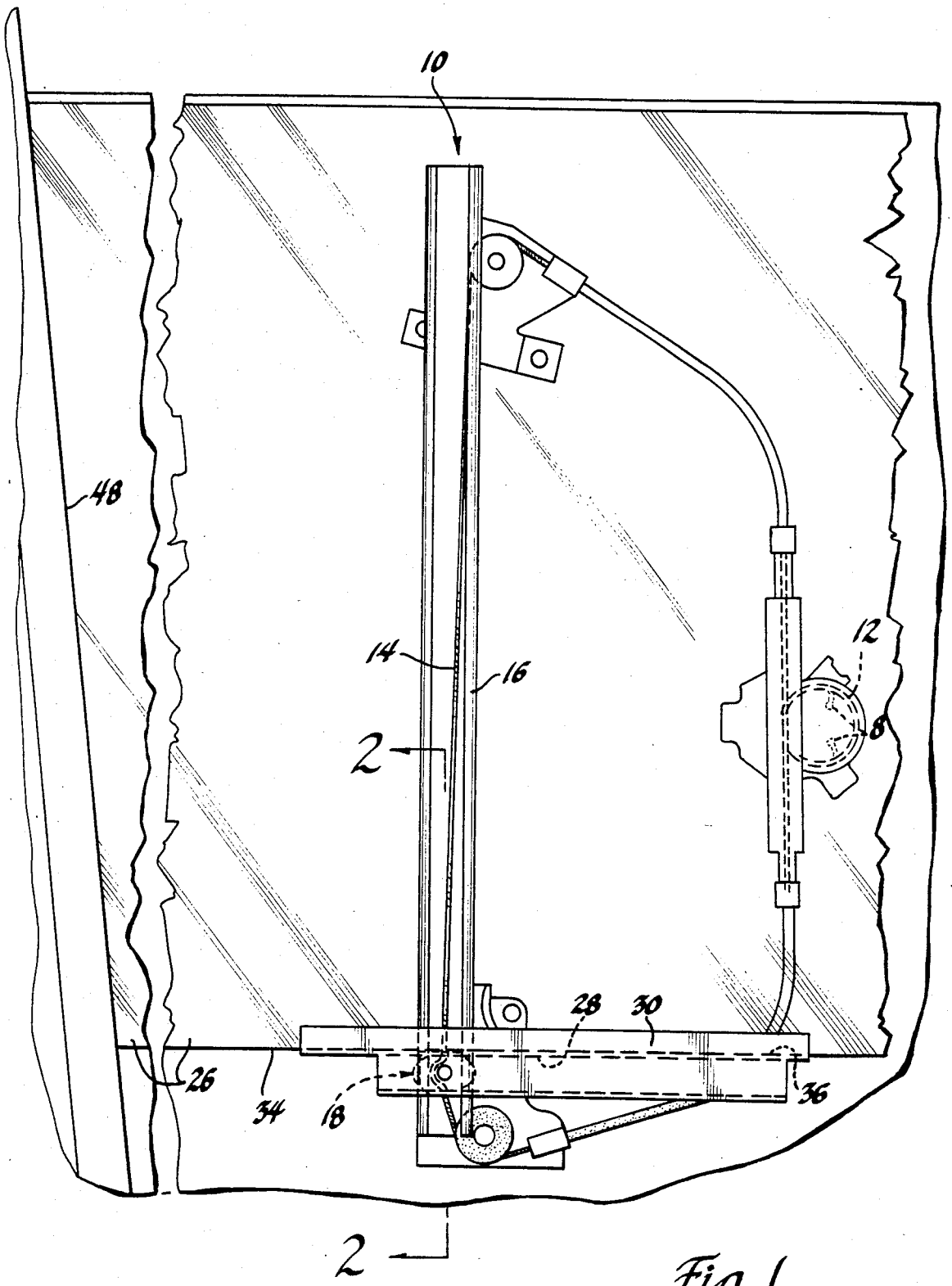
FIG. 1 is a front perspective view of a preferred embodiment of a cable window regulator of the present invention.

Referring to FIG. 1, the window regulator 10 of the present invention has four major elements. The first element is a manually or artificially powered, reversible, rotational drum 12. The second major element of the window regulator is a single length of cable 14 having both ends 8 affixed with the drum 12. The third major element of the window regulator 10 is a channel means 16 which provides a fixed path for the cable 14. The last major element of the window regulator is the slider guide assembly 18 which transmits the forces from the cable 14 to the windowpane 26.

Referring to FIGS. 1, 2, 3, and 4 the slider guide assembly 18 has two major components of a slider 20 and a guide 22. The slider, slidably attached with a sash 30, is inserted within a first horizontally open horizontal groove 28 of the sash 30. The slider 20 provides the means of attachment of the windowpane 26 to a pin 44. The pin 44 transversely projects through guide 22 as will later be explained. The bottom edge 34 of the windowpane 26 is nested within a second vertically open horizontal groove 36 of the sash 30.

Figure 5:
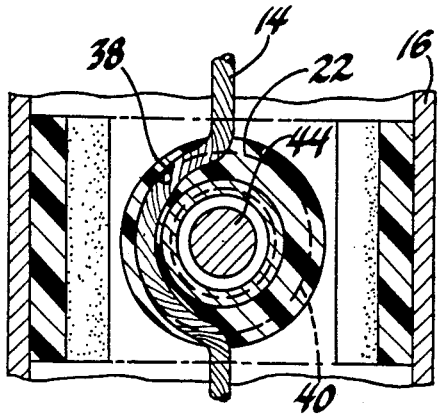
FIG. 5 is a cutaway view taken along lines 5—5 of FIG. 2.

The guide is slidably mounted in channel means 16 and is provided with a curvilinear groove 38 (FIG. 5) for placement of an intermediate portion of cable 14. The curvilinear groove 38 may be of many various configurations, however as illustrated in FIG. 5 the groove 38 has a constant radius for a segment of 150 degrees. The constant radius portion of groove 38 should not exceed 180 degrees to prevent deformation of the cable 14. Because of the curvilinear groove 38, the tension forces of the cable 14 tend to further increase the engagement of the cable with the guide 22.

Figure 2:
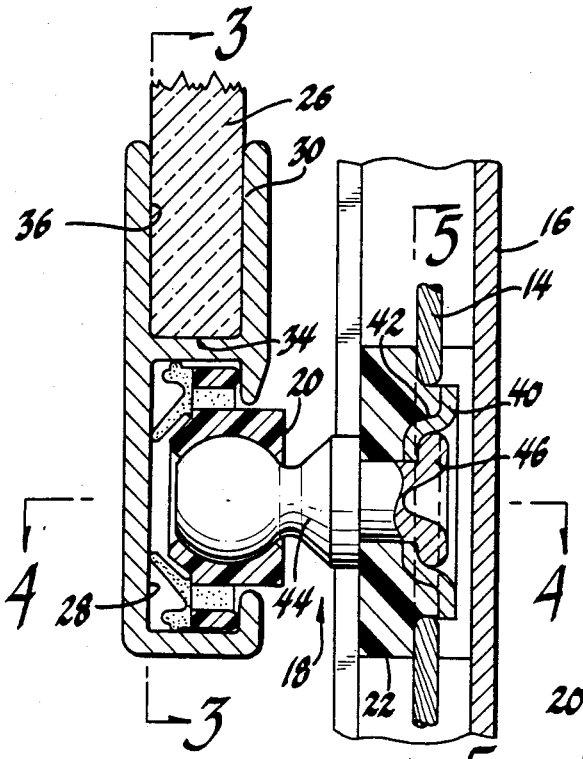
FIG. 2 is an enlarged sectional view taken along lines 2—2 of FIG. 1.
Figure 3:
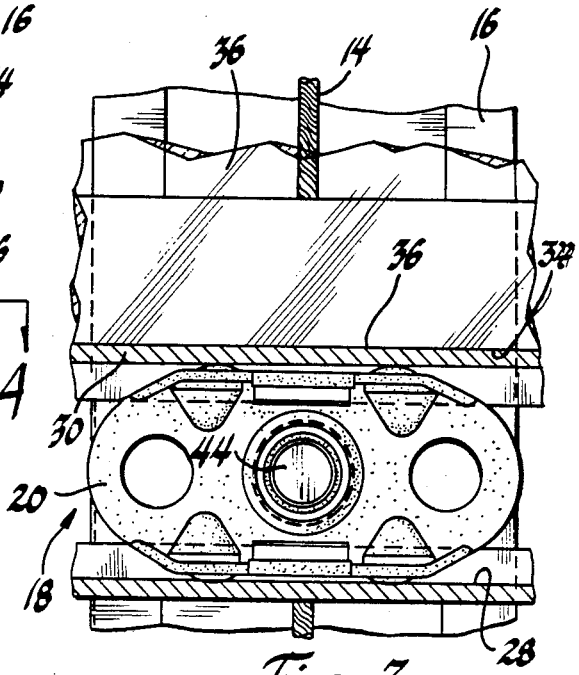
FIG. 3 is a cutaway view taken along lines 3—3 of FIG. 2.
Figure 4:
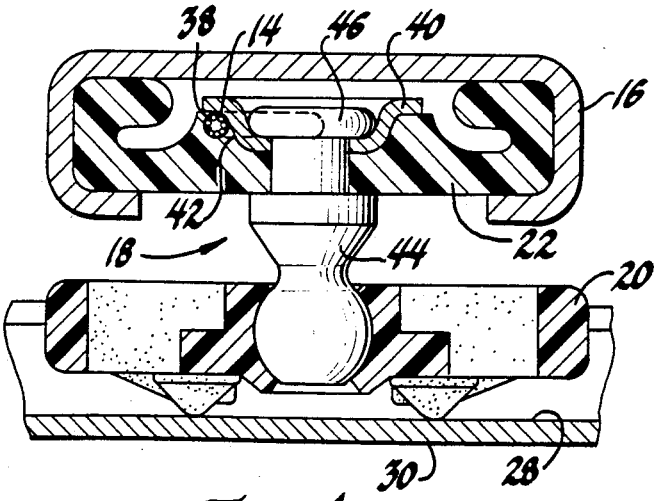
FIG. 4 is a cutaway view taken along lines 4—4 of FIG. 2.

Mated with the guide 22 opposite the slider 20 and nondeformably securing the cable 14 within the curvilinear groove 38, there is provided a bowl-shaped washer 40 (FIGS. 2 and 4). The washer 40 traps the cable in the curvilinear groove 38 and along the washer's outer curvature 42.

Projecting through the guide 22 and surrounded by the washer 40 is a metallic pin 44 which is the load bearing structural member for the guide 22 as well as the slider 20. The pin 44 is adjacent the curvilinear groove 38 and is deformed or knuckled at its end 46 to mate the washer 40 with the guide 22.

Opposite the guide 22 and pivotally mounted to the pin 44 is the slider assembly 20. As previously explained, the slider 20 is slidably attached to the windowpane 26 via sash 30. The windowpane 26 has relative horizontal movement with respect to cable 14 and follows a window edge guide 48 as the cable translates the windowpane 26 up and down.

In operation, the cable 14 is tensioned by rotation of drum 12 to either raise or lower the guide 22 along channel 16. The tension forces exerted on the cable 14 are transmitted to the pin 44 via guide 22. The load bearing pin also transmits the tension forces exerted by windowpane 26 via slider 20. Due to the shape of the curvilinear groove 38, the frictional engagement of the cable 14 with the guide 22 is increased as the cable 14 is reeled in by the drum 12 while at the same time the cable 14 is not deformed. By use of the present invention, the cable 14 has been attached with the guide 22 without being cut or being elastically deformed while at the same time a single pin 44 is utilized as a load bearing member for both the guide 22 and slider 20.

While a few of the embodiments of the present invention have been explained, it will be readily apparent to those skilled in the art of the various modifications which can be made to the present invention without departing from the spirit and scope of this application as it is encompassed by the following claims.

The embodiments of the invention in which an exclusive property or privilege is claimed are defined as follows:

1. An improved vehicle cable window regulator having a reduced number of parts, said regulator comprising in combination:
   - a reversible rotatable drum;
   - a single cable having both ends affixed with said drum;
   - a channel means providing a fixed path;
   - a guide slidably mounted in said channel means in said path, said guide providing a curvilinear groove for an intermediate portion of said cable;
   - a pin transversely projecting through said guide adjacent said groove;
   - means for attaching said pin to said window; and
   - a washer, surrounding said pin and mated with said guide trapping said cable in said groove whereby said cable is nondeformably secured to said guide.

2. A vehicle cable window regulator as described in claim 1 further including a slider mounted to said pin opposite to said guide, said window regulator also having a sash attached with said window and said slider being slidably attached to said sash.

3. A vehicle cable window regulator as described in claim 1 wherein said pin is deformed to mate said guide with said washer.

4. An improved vehicle cable window regulator having a reduced number of parts, said regulator comprising in combination:
   - a reversible, rotatable drum; a single cable having both ends affixed with said drum;
   - a channel providing a fixed path;
   - a guide slidably mounted on said channel in said path, said guide providing a curvilinear groove for said cable;
   - a pin transversely projecting through said guide, said pin being deformed at one end;
   - a slider mounted to said pin opposite said guide;
   - a sash having a first groove for insertion of said slider, and said sash having a second groove wherein the bottom edge of said window may be nested therein; and
   - a bowl-shaped washer surrounding said pin and mated with said guide opposite said slider by said pin, said washer trapping said cable on the outer curvature of said washer whereby said cable is nondeformably secured to said guide.

5. An improved vehicle cable window regulator having a reduced number of parts, said regulator comprising in combination:
   - a reversible, rotatable drum;
   - a single cable having both ends affixed with said drum;
   - a channel providing a fixed path;
   - a plastic guide slidably mounted on said channel in said path, said channel providing a curvilinear groove having a constant radius for arc of between 180 and 150 degrees for said cable;

a pin transversely projecting through said guide deformed at one end;

a slider mounted to said pin opposite said guide;

a sash having a first horizontal groove for insertion of said slider, and said sash having a second groove wherein the bottom edge of said window may be nested therein; and a bowl-shaped washer surrounding said pin and mated with said guide opposite said slider by said pin, said washer trapping said cable on the outer curvature of said washer whereby said cable is nondeformably secured to said guide.

* * * * *